United States Patent [19]

Frame et al.

[11] Patent Number: 4,540,206

[45] Date of Patent: Sep. 10, 1985

[54] ADJUSTABLE DRAW LATCH

[75] Inventors: William R. Frame, Brookhaven; James H. Vickers, Middletown, both of Pa.

[73] Assignee: Southco, Inc., Concordville, Pa.

[21] Appl. No.: 605,385

[22] Filed: Apr. 30, 1984

[51] Int. Cl.[3] ..... E05C 5/02

[52] U.S. Cl. ..... 292/66; 292/DIG. 38; 292/DIG. 49; 292/DIG. 60

[58] Field of Search ..... 292/66, 68, 63, 263, 292/113, 109, 114, DIG. 38, DIG. 49, DIG. 60

[56] References Cited

U.S. PATENT DOCUMENTS

| | | | |
|---|---|---|---|
| 1,184,439 | 5/1916 | Giles | 292/246 |
| 1,406,090 | 2/1922 | Schermuly | 292/66 |
| 2,477,472 | 7/1949 | Wright | 292/66 X |
| 2,829,912 | 4/1958 | Koch | 292/114 |
| 2,966,706 | 1/1961 | Christensen | 292/113 X |
| 3,490,805 | 1/1970 | Di Pierro et al. | 292/113 X |

*Primary Examiner*—Richard E. Moore
*Attorney, Agent, or Firm*—Paul & Paul

[57] ABSTRACT

An adjustable draw latch of the over-center type for latching two closure members has a tension-link cover which is detachably secured pivotally at one end to a keeper mounted on one of the closure members. The cover is secured pivotally at its other end to one end of an adjustable compression link. The other end of the compression link is pivotally attached to a base bracket mounted on the other closure member. The adjustable compression link includes an internally threaded nut which is pivotal within the base bracket, and a T-shaped member having an a cross head of cylindrical shape and an externally threaded stud which extends from the cross head at right angles thereto and is threaded into the pivot nut. The cross head is pivotally secured within the cover at one end thereof. The cover provides a bearing surface for the cross head.

11 Claims, 5 Drawing Figures

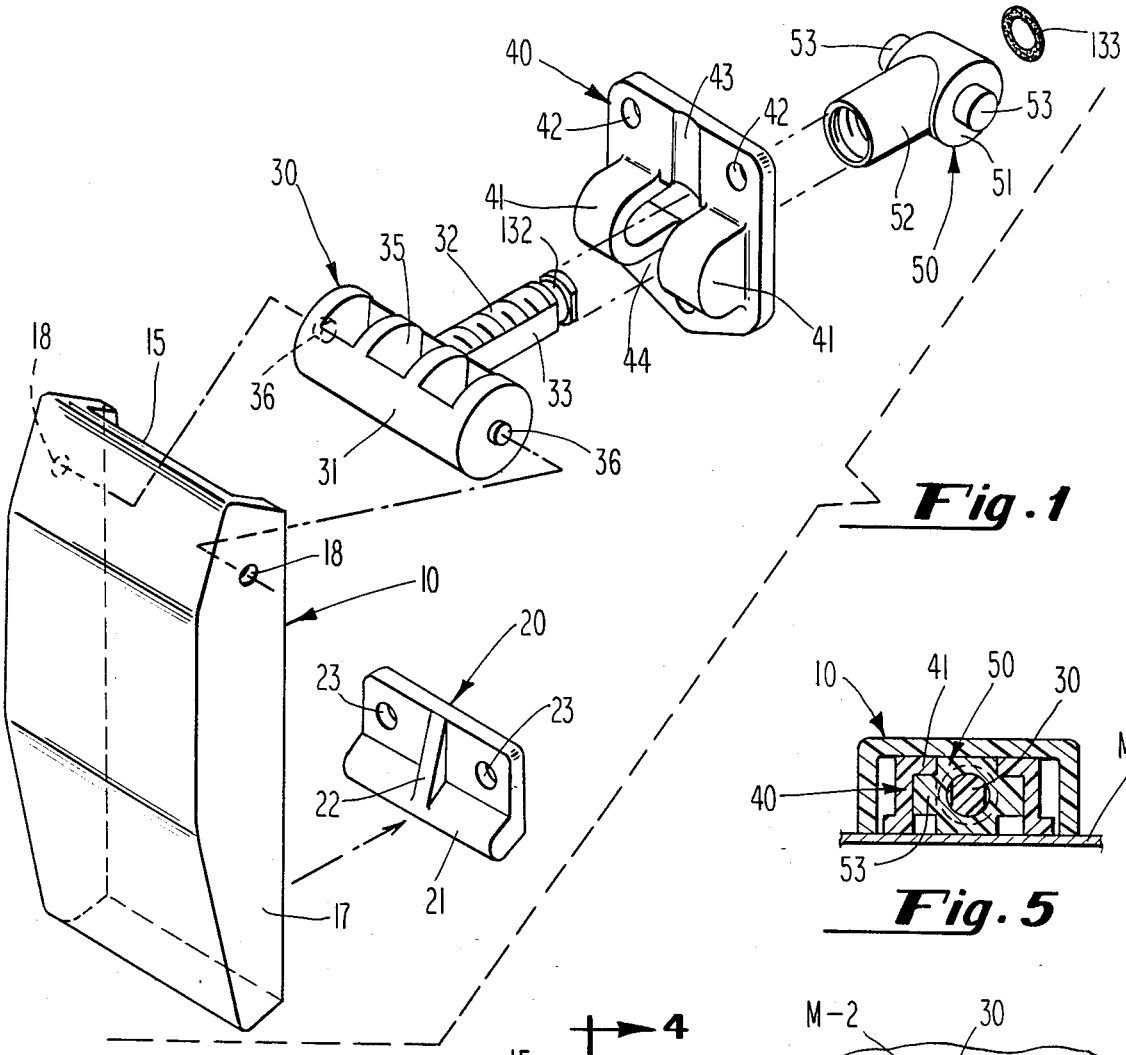
Fig. 1
Fig. 5
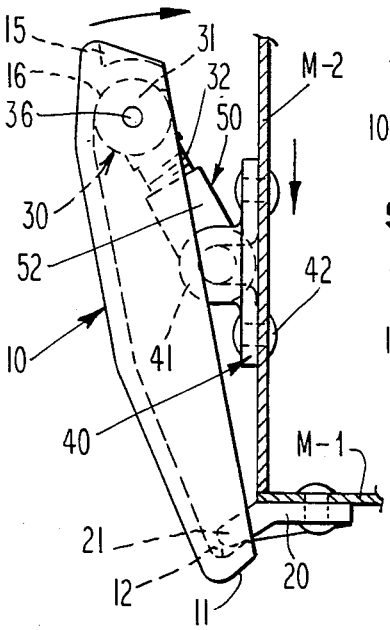
Fig. 2
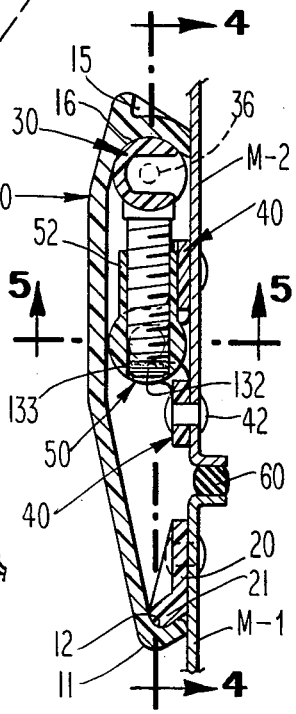
Fig. 3
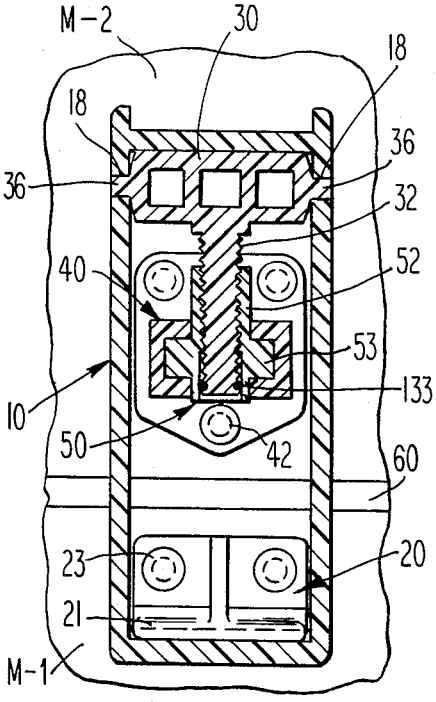
Fig. 4

ADJUSTABLE DRAW LATCH

BACKGROUND OF THE INVENTION

This invention relates to draw latches for latching together two closure members. The latch is referred to as a "draw latch" because it forceably draws together the two members on which the latch members are mounted. Such members may be components of a cabinet, or a case, or a housing for a machine, or any type of enclosure. In many cases, the closure members will be co-planar panels. But in other cases the two closure members will be angularly disposed, such as at right angles to each other.

All draw latches are basically toggle devices having three links and three pivot points. One of the pivot points is disengageable so that the latch may be unlatched to separate the closure members.

The present invention relates particularly to a draw latch of the toggle type which is adjustable. The adjustable feature is necessary, or at least desirable, because the latched members may have dimensional variations due to their method of manufacturing or because they may be subject to deformation in use. Usually the latched joint will include a gasket between the two closure members which will change in thickness or resilience in use due to age, environment, or other factors. The latch would require readjustment to properly seal the gasket.

The prior art has provided draw latches of the toggle type with means for adjusting the distance between latching points. Some prior art adjustable latches incorporate a screw thread in the link which is to be stressed in tension. This introduces an undesirable feature, namely, if the latch be loaded beyond its maximum holding strength, there would be a complete failure of the latch mechanism.

Also in some prior art adjustable draw latches, the threaded tension link is the detachable link and is articulated with the handle lever in such manner that the latching operation involves two motions: (1) engagement of the detached link with its cooperating element and (2) the lever action to close the latch. Depending on the orientation of the latch with respect to gravity or other outside forces, the latching operation may require two hands.

Another deficiency of prior art adjustable draw latches resides in the complexity of the mechanism due to the attachment of the link. Usually rivets and cross pins are required to provide the pivoting joint.

A further disadvantage of the prior art adjustable draw latch is the generally unpleasing appearance of the device. Due to the geometry of the articulated members, the mounting hardware and other aesthetically objectionable features are exposed to view.

SUMMARY OF THE INVENTION

A principal object of the present invention is to provide an improved adjustable draw latch of the toggle action type.

A more specific object is to provide an adjustable draw latch of the toggle action type in which the adjustably threaded link is in compression, not tension, when the latch is engaged.

Another object is to provide such an adjustable draw latch having a simplified design for economical manufacture and assembly.

Another object is to provide a latch which may be engaged and latched in a single motion.

Another object is to provide an adjustable draw latch of the toggle action type which is of more pleasing appearance.

Another object is to provide an adjustable draw latch in which the tension link is a larger member of the assembly which covers and conceals the other components when in latched position, thereby providing a stylish unclutered appearance and free of hazardous protruding elements.

Yet another object is to provide an adjustable draw latch of the foregoing type in which all of the components are molded of engineering plastic resin, thereby to provide a latch that is entirely resistant to corrosion and is nonmagnetic.

BRIEF DESCRIPTION OF THE DRAWINGS

FIG. 1 is an exploded perspective view showing the components of the improved adjustable draw latch according to the present invention.

FIG. 2 is a view showing the adjustable draw latch being moved in the direction of the arrow toward fully latched position to draw together and to latch two closure members which are at right angles to each other.

FIG. 3 is a view, in section, showing the adjustable draw latch in fully latched position having drawn together and latched two closure members which are co-planar and sealed by a gasket.

FIG. 4 is a view, in section, looking along the line 4—4 of FIG. 3.

FIG. 5 is a view, in section, looking along the line 5—5 of FIG. 3.

DETAILED DESCRIPTION OF THE PREFERRED EMBODIMENTS

FIG. 1 is an exploded view showing in perspective the various components of the latch of the present invention. Reference numeral 20 identifies a keeper having a lip 21, a reinforcing rib 22, and holes 23 for securing the keeper to one of the closure members M-1 as by rivets. Reference numeral 40 identifies a base member or bracket which is secured to the other closure member M-2, as by rivets through holes 42. However, before placing the base member or bracket 40 on closure member M-2, a pivot nut 50 is inserted from the mounting side into the base member 40. As seen in FIG. 1, pivot nut 50 comprises a generally cylindrical body portion 51 having stub pivot posts 53 extending laterally therefrom in opposite directions. Extending outwardly from the cylindrical portion 51, at right angles to the center axis of the cylindrical body portion 51, is an internally threaded nut or sleeve portion 52.

Base member or bracket 40 is provided with a central opening 44 which receives sleeve 52 and also the cylindrical body 51 of the nut 50. When base member 40, with nut 50 inserted thereinto, is mounted on member M-2, the pivot nut 50 is retained in base member 40 by the surface of the member M-2. When fully inserted, the stub pivot posts 53 bear against the inner surfaces of the bearing blocks 41, and sleeve 52 projects outwardly therebeyond, as is seen in FIG. 2.

Threaded into the internally threaded nut or sleeve 52 is a T-shaped stud member 30 having a cylindrical cross head 31 and, at right angles thereto, a threaded stud portion 32.

The end of the threaded stud portion 32 is preferably provided with an annular groove 132 which receives a rubber O-ring retainer 133. The O-ring is not placed on the stud 132 until after the stud has been fully threaded into the pivot nut 50 and the end of the stud projects beyond the nut and also beyond the bracket 40. After O-ring 133 is placed in the groove 132, the stud 32 is rotated in the outward or withdrawal direction until the O-ring comes into engagement with the threaded sleeve 52. The O-ring then causes the stud to jam, and further rotation in the withdrawal direction is not possible, or at least very difficult. A principal advantage of O-ring 133 is that it permits adjustment of stud 32 in either direction so long as the O-ring is in engagement with the unthreaded bore of pivot nut 50, but when during unthreading adjustment the O-ring comes into engagement with the threads of sleeve 52, further adjustment in the withdrawal direction is prevented. Thus, the length of stud 32 within sleeve 52 is always sufficient to assure that the connection between stud 32 and nut 50 is strong and stable, and sufficient to carry the compressive load impressed thereon during latching. Thus, O-ring 133 not only captures the stud in sleeve 52, thereby preventing separation of the stud and nut; it also guarantees a strong stable connection.

The threaded stud portion 32 is illustrated as having flat sides 33 but such flat sides 33 are merely desirable for molding purposes. They serve no functional purpose so far as the operation of the draw latch is concerned. Similarly, the cylindrical cross head 31 of the stud member 30 is shown as having recesses 35, but here again such recesses 35 are merely desirable for molding purposes and serve no functional purpose so far as the operation of the draw latch is concerned.

Extending outwardly in opposite directions from the cylindrical cross head 31 of the stud member 30 are stub pivot posts 36. These stub pivot posts are adapted to be received within holes 18 in the sidewalls 17 of the cover 10.

All of the component parts of the adjustable draw latch of the present invention are preferably molded of engineering plastic resin with the resilience necessary for assembly of the components.

Thus, the upper end of the cover 10, as viewed in the drawing, may be placed over the cylindrical body portion 31 of the T-shaped stud member 30 and snapped into place, with the pivot posts 36 being received within the holes 18 in the sidewalls 17 of the cover.

Reference is now made to FIG. 2. This figure shows the draw latch about to be moved, as by manually applying a light force to the upper end of the cover 10, in the direction of the arrow toward fully latched position, which is shown in section in FIG. 3. In FIG. 2, the tip of the hooked nose portion 11 at the lower end of cover 10 is in detachable engagement with the keeper 20 and the inner radius 12 of hook portion 11 is about to engage the corresponding outer radius of lip 21 of keeper 20. In the position illustrated in FIG. 2, members M-1 and M-2 which are disposed at right angles to each other, are being drawn toward each other by the toggle action of the latch.

In FIG. 3, the draw latch is illustrated in fully latched position, latching together two members which are disposed in co-planar relationship. The inner radius 12 of the hooked nose portion 11 has now come into contact with the corresponding outer radius of lip 21 of keeper 20. When the latch is moved from a position which is on the open side of the "on-center" position to the "over-center" fully latched position illustrated in FIG. 3, the outer radius of cylindrical body 31 bears against the corresponding inner radius 16 at the upper end of cover 10. Thus, in the fully latched position, the pivoting joints created by radius 12 with lip 21, and radius 16 with cylindrical body 31, are positioned, with respect to pivot posts 53 in bearing blocks 41, in an over-center arrangement characteristic of toggle mechanisms.

When cover 10 is under maximum tension, as it is when it passes through the "on-center" position, the second link, comprising the threaded stud 32 and the internally threaded sleeve 52, is under maximum compression. If this compressional force should exceed that which the threaded connection can withstand, the failure would not be catastrophic. Rather, it would be a controlled deformation, and members M-1 and M-2 would remain latched.

To unlatch the latch, an outward force is applied manually to the upper end of cover 10, as by placing the fingers under the flange 15.

To adjust the latch, T-member 30 is rotated in mating threaded sleeve 52 in one direction or the other depending upon whether it is desired to increase or decrease the latching force. With cover 10 attached, the T-member may be rotated through multiples of 360 degrees so that the cover is properly oriented to engage keeper lip 21. Should finer adjustment be desired, cover 10 can be disconnected from T-member 30 which may then be rotated through multiples of 180 degrees. Cover 10 is then re-attached to T-member 30 in proper orientation for engagement with keeper lip 21. Detaching cover 10 from member 30 is readily accomplished because the resilience of sidewalls 17 of the cover allows disengagement of pivot posts 36 from holes 18.

As already indicated, an important feature of the adjustable draw latch of the present invention is that the threaded link is in compression, not tension, when the latch is engaged. The advantage of this feature is that, in the event the latch should become overloaded, causing the threaded connection to fail, such failure of the threaded link would not result in a catastrophic failure of the latch.

Another feature of the latch of the present invention is that the cover is the largest member of the assembly which covers and conceals all of the other components, resulting in the absence of hazardous exterior projections and simple stylish unclutered appearance.

Another feature is that the structural arrangement of the new latch allows high latching loads to be carried through the articulated joints without the use of cross pins, rivets or other additional pivot components. This result is obtained largely because the interior radius 16 of the cover 10 at its upper end corresponds to the outer radius of the cylindrical body portion 31 of the T-member 30, thereby providing a bearing surface, during latching, for the full width of cylindrical body 31. The latching load is, therefore, not carried by the pivot posts 36. They only provide retention and articulation in the unlatched condition. This makes it unnecessary to have a cross pin extending all the way through the cylindrical body 31 on the center axis thereof.

When the members M-1 and M-2 are fully latched, the gasket 60 is in compression, as illustrated in FIG. 3.

It will be seen from the foregoing description that the new adjustable draw latch of the present invention includes a first detachable pivot point which is provided by the hook nose portion 11 of the cover in cooperation with the lip portion 21 of a keeper 20 mounted on one of the panel members. The latch cover extends from the first pivot point to a second pivot point which is provided by the cylindrical body portion of T-shaped threaded stud member 30. Stub pivot shafts on the cylindrical body are received within holes 18 in the sidewalls of the cover 10. Extending from the second pivot point to a third pivot point located on the other panel member is a threaded assembly which provides for the adjustment of the latch. The third pivot point is provided by an internally threaded pivot nut 50 which is mounted pivotally in a base member 40 and which receives the threaded stud of the T-shaped member. During latching, the cover is under tension and the adjustable threaded link is under compression. The latch cover has a curved inner surface at its one end which mates with the curved surface of the cylindrical body portion of the T-shaped stud so as to provide bearing support for the full length of the cylindrical body portion of the T-shaped stud.

What is claimed is:

1. An adjustable draw latch for latching together two closure members, said latch comprising:

a. a keeper adapted to be secured to one of said closure members;

b. a latch base bracket adapted to be secured to the other of said closure members, said bracket having a central opening therein and having a pair of bearing blocks, one on each side of the opening;

c. a pivot nut having an internally-threaded sleeve portion projecting into said central opening of said bracket, said nut having at right angles to its sleeve portion a cylindrical body portion having stub pivot shafts projecting from opposite ends on the center axis thereof and received within said bearing blocks;

d. a T-shaped stud member having a cylindrical cross head and an externally threaded stud portion projecting from said cylindrical cross head at right right angles thereto, said externally threaded stud portion being received within the internally threaded sleeve portion of said pivot nut;

e. a latch cover having depending sidewalls on opposite sides thereof and said sidewalls being provided with means near one end for pivotally retaining the ends of the cylindrical cross head of said T-shaped stud member, said latch cover having a hook portion at the other end for detachably engaging said keeper.

2. An adjustable draw latch according to claim 1 wherein said keeper has a lip portion having an exterior radius, and wherein said hook portion of said cover has an interior radius corresponding to that of the exterior radius of said lip portion of said keeper, for matingly engaging said lip portion during latching.

3. An adjustable draw latch according to claim 1 wherein said cover at the end remote from said hook portion, is provided with a curved interior surface having an interior radius corresponding to the exterior radius of the cylindrical body portion of said T-shaped stud member, the construction and dimensions being such that during latching said interior radius of said cover provides bearing support for the full length of said cylindrical body portion of said T-shaped stud member.

4. An adjustable draw latch according to claim 2 wherein said cover, at the end remote from said hook portion, is provided with a curved interior surface having an interior radius corresponding to the exterior radius of the cylindrical body portion of said T-shaped stud member, the construction and dimensions being such that during latching said interior radius of said cover provides bearing support for the full length of said cylindrical body portion of said T-shaped stud member.

5. An adjustable draw latch according to claim 4 wherein the cross head of the T-member includes stub projections on its opposite ends and wherein the means provided in the cover for pivotally retaining the cross head consists of holes in the sidewalls which receive said stub projections.

6. An adjustable draw latch according to claim 4 wherein the end of said threaded stud portion is provided with an annular groove having therein a resilient retainer.

7. An adjustable draw latch according to claim 4 wherein at least a majority of the components of said latch are of molded plastic resin.

8. An adjustable draw latch for latching together two closure members, said latch comprising:

a. a keeper adapted to be secured to one of the closure members;

b. a bracket adapted to be attached to the other of said closure members;

c. a cover having one end adapted to be pivotally and detachably connected to said keeper;

d. an adjustable compression link having one end pivotally secured to the other end of said cover and having its other end pivotally connected to said bracket;

e. said adjustable compression link including an internally-threaded nut pivotally connected to said bracket, and a T-shaped member having an externally threaded stud received within said internally-threaded nut.

9. An adjustable draw latch according to claim 8 wherein said T-shaped member includes a cross head of cylindrical shape received within said other end of said cover.

10. An adjustable draw latch according to claim 9 wherein said other end of said cover has an interior radius corresponding to the exterior radius of said cylindrical cross head of said T-shaped member.

11. An adjustable draw latch according to claim 10 wherein said keeper has a lip having an exterior radius, and said one end of said cover has an interior radius corresponding to said exterior radius of said keeper lip.

* * * * *